United States Patent [19]

Grewe

[11] Patent Number: 4,696,136

[45] Date of Patent: Sep. 29, 1987

[54] SIMULATED PIPE CONSTRUCTION

[75] Inventor: Ronald E. Grewe, Novi, Mich.

[73] Assignee: Marketing Displays, Inc., Farmington Hills, Mich.

[21] Appl. No.: 895,452

[22] Filed: Aug. 11, 1986

[51] Int. Cl.[4] ..... E04B 1/00

[52] U.S. Cl. ..... 52/222; 52/287; 52/746; 52/311

[58] Field of Search ..... 52/287, 288, 311, 716, 52/718.1, 242, 222, 741, 746; D25/74, 75

[56] References Cited

U.S. PATENT DOCUMENTS

| | | | |
|---|---|---|---|
| D. 251,444 | 3/1979 | Bancroft et al. | D25/74 |
| 1,825,010 | 9/1931 | Murphy | 52/287 |
| 2,681,716 | 6/1954 | Black | 52/718.1 |
| 3,405,488 | 10/1968 | Nelson | 52/287 |
| 3,579,939 | 5/1971 | Eichman | 52/397 |
| 3,825,229 | 7/1974 | Bartlett et al. | 256/59 |
| 4,129,967 | 12/1978 | Barlow | 52/15 |
| 4,258,515 | 3/1981 | Owen | 52/288 |

*Primary Examiner*—James L. Ridgill, Jr.

*Attorney, Agent, or Firm*—Harness, Dickey & Pierce

[57] ABSTRACT

The simulated pipeline construction gives the outward appearance of an actual plumbing pipeline but without the weight or expense. The pipeline is constructed using a pair of parallel mounting rails which hold one or more outwardly bowed flexible plastic panels. One-piece plastic corner members are used to simulate a pipeline extending around a corner of a building, and one-piece plastic end caps are used to simulate an actual plumbing end cap. The corner members and end caps are also inserted into the channels of the mounting rails.

44 Claims, 15 Drawing Figures

FIG. 3.
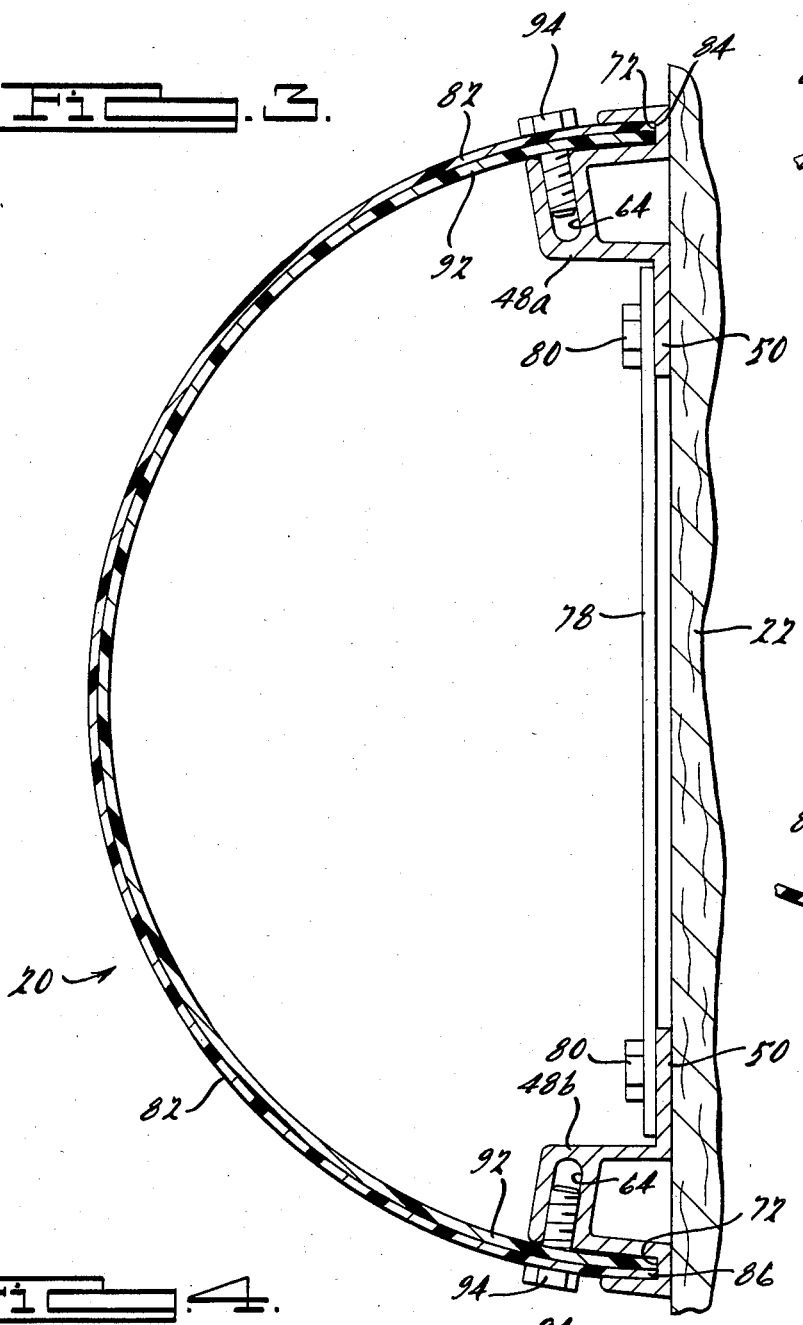
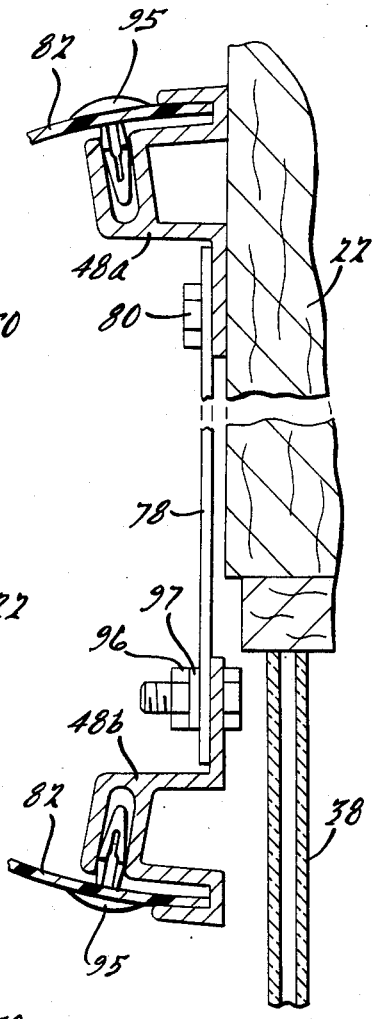
FIG. 5.
FIG. 4.
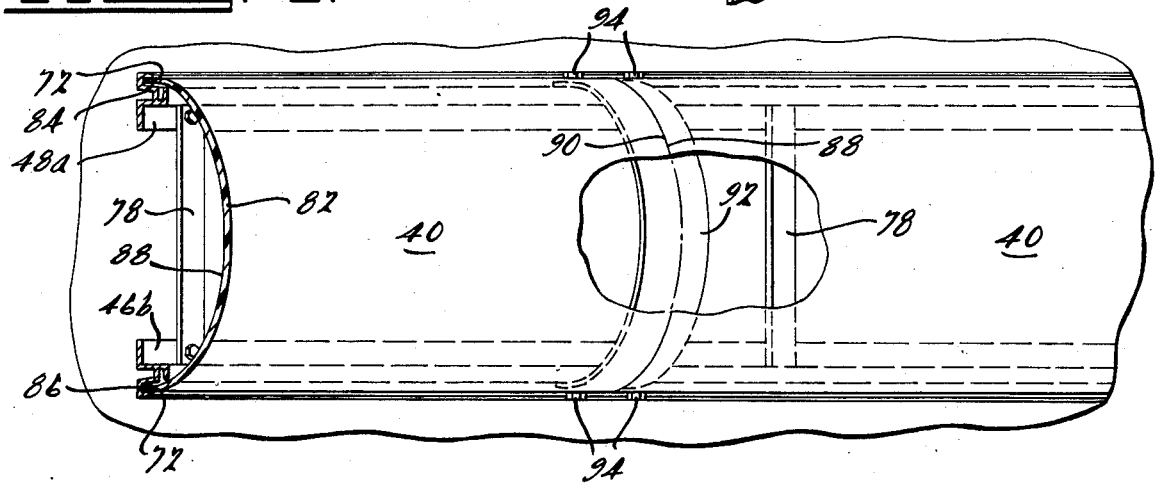

SIMULATED PIPE CONSTRUCTION

BACKGROUND AND SUMMARY OF THE INVENTION

The invention relates generally to advertising displays and more particularly to a display device and method for simulating plumbing pipes, pipelines and the like for advertising and building adornment.

It is now customary for chain stores and franchise retailers to use a standardized commercial building appearance in order to convey the nature of the business or to convey a theme. A standardized appearance is also useful in advertising, and it helps the consumer identify a store or establishment as the source of particular goods or services.

Often the building architecture of a particular chain store or franchise will vary from one building to another, depending upon the building's location, the lot size, local zoning and building code regulations and the era in which the building was constructed. Because of these architectural differences, it is sometimes necessary to use building adornments in order to create a unifying theme and in order to convey a standardized appearance. Ideally, such adornments should be inexpensive, easy to install and should require low maintenance. Given the wide variance in building architecture, these objectives have not been easy to achieve.

For example, consider the problem of implementing a pipeline theme, where a pipeline extending around several faces of a building must be simulated. Ideally, the simulated pipeline should have the outward appearance of an actual plumbing pipeline. The simulated pipe construction should be capable of extending around both inside and outside corners of a building, should be able to traverse downspouts without interfering with the downspout function, should be capable of placement in close proximity to overhanging eaves where applicable and should also be capable of traversing window and door openings. The simulated pipe construction should be lightweight, easy to ship and install and should require low maintenance. Preferably, the simulated pipe construction should not require periodic painting and should be easy to repair if sections of the simulated pipeline become damaged. These requirements have not been met in prior art constructions.

Accordingly, in order to fulfill the need for a simulated pipe construction, the invention provides a construction, apparatus and method for providing a simulated pipe or pipeline for attaching to a building having a plurality of corner defining faces. The simulated pipe construction comprises first and second pipe sections for attaching to two adjoining faces of a building in order to simulate a pipe extending around a corner of the building. Each pipe section has at least one elongated and flexible panel which has first and second edges in the longitudinal dimension and third and fourth edges in the transverse dimension. Each pipe section has at least one holding means which has first and second edge securing means in spaced relation to one another for holding the first and second edges of the flexible panel. The edge securing means are closer together than the transverse dimension of the panel, so that the panel assumes an outwardly bowed, arc-shaped configuration when held along the first and second edges by the holding means. The corner member has an arc-shaped exterior which geometrically conforms to the arc-shaped configuration of the panel and has means for receiving and joining the third edge of the first pipe section with the fourth edge of the second pipe section. The pipe sections, when so joined, lie on lines which intersect one another to simulate a pipeline extending around a corner of the building.

The invention is well adapted for storage, shipment and assembly in a modular form or kit form. The apparatus for assembly of a simulated pipe construction includes first and second elongated mounting rails, each having an attachment portion for securing to a building and also having a channel forming portion which defines an outwardly presenting, elongated channel. The rails are held in a spaced-apart and parallel configuration by at least one spreader member or bar. The spreader member attaches to and holds the rails a predetermined distance apart. The apparatus further includes at least one elongated and flexible panel member which has longitudinally extending edges for insertion into the channels of the first and second rails. The panel member has a greater width than the predetermined distance between the rails. Thus, when the panel member is inserted into the channels of the rails, it takes on an outwardly bowed configuration. The elongated mounting rails may be readily cut to length and attached to the building during assembly of the simulated pipe.

According to the invention, the mounting rail comprises an elongated extrusion having an attachment portion which lies substantially in a first plane and which has an inwardly facing attachment side and an outwardly facing side. The extrusion also has an extension portion which extends laterally outwardly from the attachment portion and lies substantially in a second plane. The extrusion further has first and second fastener receiving flanges which extend from the extension portion and lie generally parallel to one another to define a fastener receiving channel. The fastener receiving channel lies substantially in a third plane which intersects the second plane. The extrusion also has a panel holding portion which extends laterally inwardly from the second fastener receiving flange. The holding portion has first and second panel holding extensions which lie generally parallel to one another to define a panel receiving channel. The panel receiving channel lies substantially in a fourth plane which intersects the first and third planes.

According to the method of the invention, a simulated pipeline is implemented as follows. A first mounting rail having an elongated outwardly presenting channel is secured to the building. A second mounting rail also having an elongated outwardly presenting channel is located in a spaced apart and parallel relation to the first rail at a fixed predetermined distance. The second mounting rail is also secured to the building. One longitudinal edge of at least one elongated flexible panel is inserted in the channel of the first mounting rail. The panel has a transverse dimension greater than the predetermined distance at which the mounting rails are spaced apart. The panel is then outwardly bowed and a second longitudinal edge of the panel is inserted in the channel of the second mounting rail. The longitudinal edges are then secured in the channel.

For a more complete understanding of the invention, reference may be had to the following specification and to the accompanying drawings.

BRIEF DESCRIPTION OF THE DRAWINGS

FIG. 3 is a cross-sectional view of the invention taken substantially along the line 3—3 in FIG. 1 illustrating the apparatus and method of assembly in greater detail;

FIG. 4 is a partial perspective view of the simulated pipe construction, showing a portion of the panels broken away to reveal the backing member;

FIG. 5 is a cross-sectional view similar to that of FIG. 3, illustrating an installation in which the simulated pipe slightly overhangs a building aperture such as a window;

FIG. 9 illustrates the manner in which the invention can be made to accommodate or pass around downspouts and the like;

DESCRIPTION OF THE PREFERRED EMBODIMENT

Figure 1:
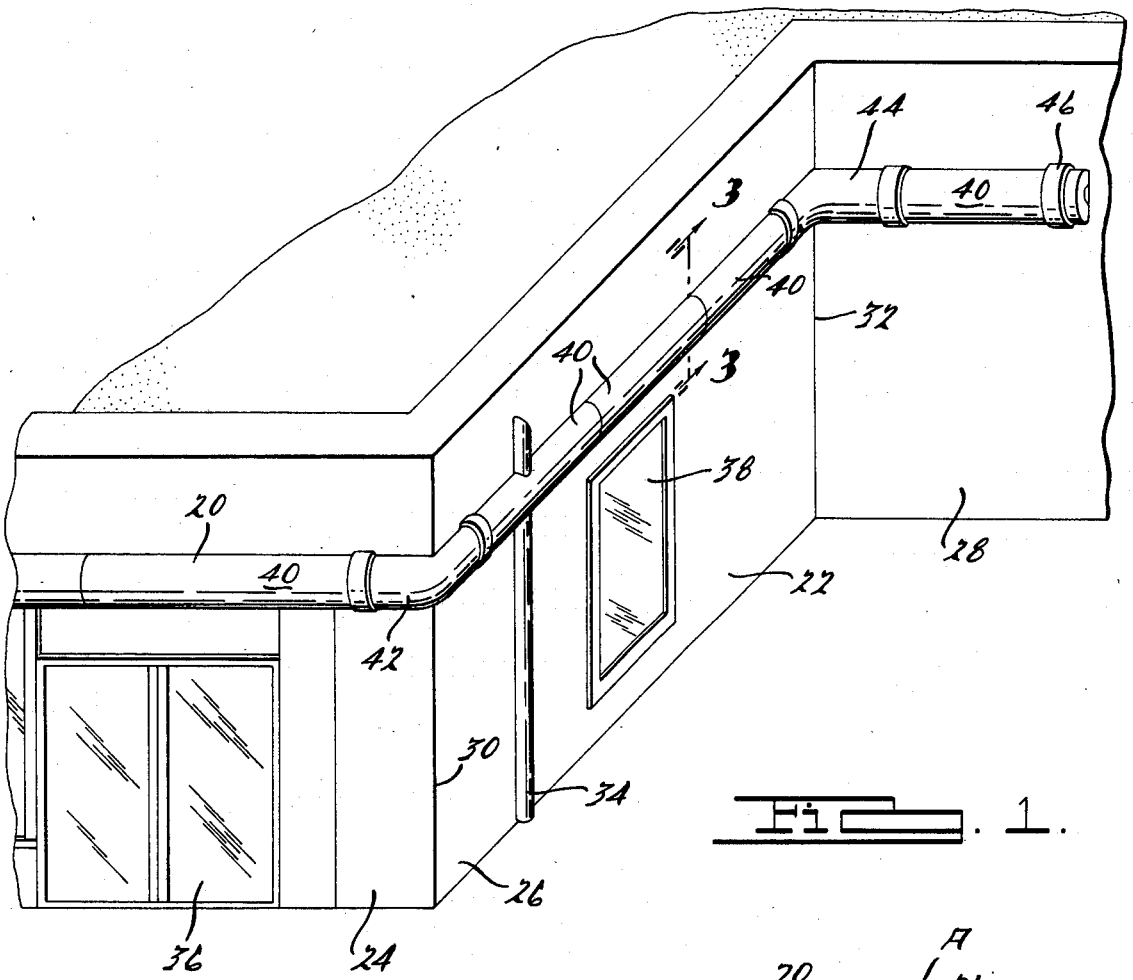
FIG. 1 is a perspective view of a building illustrating the simulated pipe construction and the apparatus of the invention in use.

Referring to FIG. 1, the simulated pipe of the invention is illustrated generally at 20. The pipe is secured to the faces of a building 22. For illustration purposes, building 22 comprises a plurality of corner defining faces 24, 26 and 28. Faces 24 and 26 define an outside corner 30, while faces 26 and 28 define an inside corner 32. Building 22 includes a conventional downspout 34, as well as conventional building apertures such as doors 36 and window 38. It will, of course, be understood that the building illustrated in FIG. 1 is merely exemplary and that the invention is capable of being used on a wide variety of different types of buildings and other architectural structures.

As illustrated in FIG. 1, the simulated pipe 20 comprises a plurality of end-to-end simulated pipe sections 40, outside corner member 42, inside corner member 44 and end cap member 46. Preferably, simulated pipe 20 has a semicircular or half-round configuration which gives the appearance of an actual, fully round plumbing pipe. FIG. 3 illustrates the semicircular configuration of the simulated pipe 20.

Figure 2:
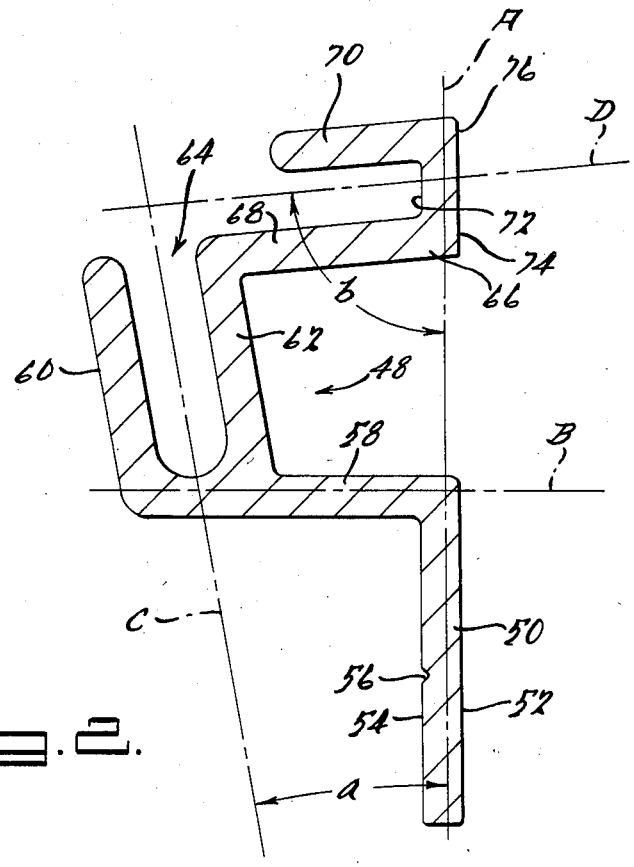
FIG. 2 is a cross-section of the extruded mounting rail of the invention.

The simulated pipe is constructed using elongated mounting rails which support the pipe sections, the corner members and the end caps and secure them to the building. FIG. 2 illustrates the preferred cross-section of the mounting rail 48. Preferably, mounting rail 48 is extruded from aluminum or another rigid material. Mounting rail 48 has an attachment portion 50 which lies substantially in a first plane A and which has an inwardly facing attachment side 52 and an outwardly facing side 54. The outwardly facing side has a longitudinally extending pilot groove 56 which may be used in locating the position of mounting holes for receiving threaded fasteners. Mounting rail 48 also has an extension portion 58 which extends laterally outwardly from the attachment portion. Extension portion 58 lies in a second plane B which lies preferably at right angles to plane A. Extending from the extension portion 58 are first and second fastener receiving flanges 60 and 62. Flanges 60 and 62 lie generally parallel to one another and define therebetween a fastener receiving channel 64. The fastener receiving channel lies substantially in a third plane C which intersects plane B. Preferably, flanges 60 and 62 are angled upwardly and outwardly so that plane C, if extended, will intersect with plane A in an acute angle "a". In the presently preferred embodiment, angle "a" is on the order of 10°-15°.

Mounting rail 48 further includes a panel holding portion 66 which extends laterally inwardly from the second fastener receiving flange 62. Holding portion 66 has first and second panel holding extensions 68 and 70 which lie generally parallel to one another and define a panel receiving channel 72. As illustrated, extension 68 integrally joins flange 62. The panel receiving channel 72 lies substantially in a fourth plane D which intersects first plane A and third plane C. In the preferred embodiment, planes A and D intersect at an acute angle "b" of approximately 80°-85°. Holding portion 66 also includes a base portion 74 which is disposed between and connects the panel holding extensions 68 and 70. Base portion 74 preferably lies in plane A and has an inwardly facing side 76 adapted to rest flush upon a building structure surface when attachment side 52 is resting flush upon the same surface.

The mounting rail may be furnished in an assortment of different lengths, or the rail may be cut to a particular length at the factory or at the site. As illustrated in FIG. 3, the simulated pipe construction uses two mounting rails, an upper mounting rail 48*a* and a lower mounting rail 48*b*. Rails 48*a* and 48*b* are held in spaced apart, parallel relation to one another using one or more spreader bars 78. The rails are secured to spreader bar 78 using threaded fasteners 80. Similar threaded fasteners 80 also serve to hold the attachment portions 50 of the mounting rails to the building 22.

With reference to FIGS. 3 and 4, the pipe sections 40 each comprise elongated flexible panels 82 which are bowed outwardly into an arc-shaped or semicylindrical-shaped configuration. Panels 82 have upper and lower longitudinal edges 84 and 86 which are insertable into and received by channels 72 of upper and lower mounting rails 48*a* and 48*b*, respectively. Panels 82 are preferably constructed from rectangular plastic stock, preferably of a high-impact, weather-resistant polymer plastic or thermoplastic, such as ROVEL polymeric material from The Dow Chemical Co. The longitudinal edges 84 and 86 are mutually parallel for insertion into channels 72 along the entire length of the mounting rails, and the transverse edges 88 and 90 are orthogonal to the longitudinal edges. As seen in FIG. 4, adjacent panels are aligned at the transverse edges, with the transverse edge 90 of one panel abutting or slightly overlapping the transverse edge 88 of the adjacent panel. Positioned behind the abutting transverse edges is a metal backing member 92. Backing member 92 may be fashioned from spring steel or the like and is sized to contact and support the underside of panels 82. As seen in FIG. 3, backing member 92 is inserted into the channels 72 of the upper and lower mounting rails 48*a* and 48*b* underneath the panels 82. Preferably, a pair of holes (not shown) are provided at each end of the backing member 92 for ease of installation and assembly.

The outwardly bowed configuration of the panels results from the length relationship of spreader bar 78 to the transverse dimension of the panels. Spreader bar 78 is of a length which places channels 72 at a predetermined distance apart which is less than the transverse dimension of the panel. The panels may be constructed from flat stock or partially bowed stock which become bowed or further bowed when inserted into the channels during assembly. Spring forces in the panel, tending to return the panel to its original flat or slightly bowed condition prior to installation, provide outward forces at the longitudinal edges which tend to hold the panel in the channels during assembly. For a more permanent installation, threaded panel mounting fasteners 94 are inserted through the panels 82 and backing members 92 and threaded into the fastener receiving channels 64. Preferably, the channels 64 are slightly smaller in width than the size of the threaded fasteners 94, allowing fasteners 94 to be self-tapping.

In place of the threaded fasteners 94, it is also possible to use plastic pins (or "push darts") 95, as shown in FIG. 5. Since the bowing of the panels 82 holds the panels in place in the channels 72 adequately by friction, the less expensive and easier fastening push darts 95 can be used to secure the panels in place.

As seen in FIGS. 1 and 3, the mounting rails are positioned so that the attachment portions 50 fall inside of the pipe sections 40 and are hidden from view. When the pipe sections are situated across or along the face of a building, as shown in FIG. 1, a realistic simulated pipe construction is formed which resembles a real pipeline.

In many installations, both the upper and lower mounting rails may be secured directly to the building face. In some applications, it may be necessary for the simulated pipe to traverse a building aperture such as a window or door. In these applications, it may be necessary for one of the mounting rails to be suspended over or overhang the opening. One way of accomplishing this is illustrated in FIG. 5. In FIG. 5, the upper mounting rail 48*a* is attached to building 22 using fastener 80 in the usual fashion. Lower mounting rail 48*b* is suspended over window 38 and is attached by spreader bar 78 and nut and bolt fastener 96 to the upper mounting rail. A lock washer 97 is also utilized.

Figure 6:
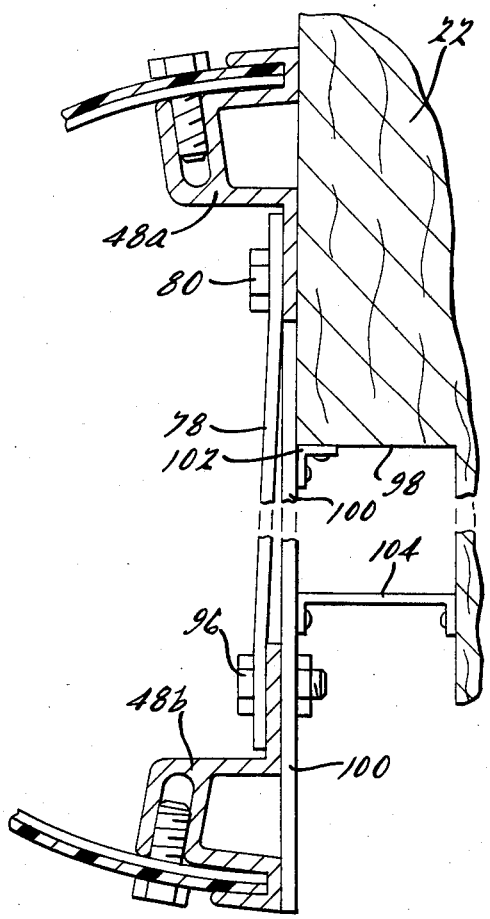
FIG. 6 is a similar cross-sectional view illustrating an installation in which the simulated pipe more substantially overhangs a building aperture.

It is also possible to use a thicker "heavy duty" spreader bar (not shown) in place of bar 78 in order to more securely suspend the bottom rail across a window or other area not suitable for a mounting fastener 80. If thicker spreader bars are used, they should be positioned every three or four feet along the rails.

Where the overhang is more substantial or where one of the mounting rails must traverse a large opening, it is possible to employ additional hardware as illustrated in FIG. 6. In FIG. 6, a more substantial building overhang 98 is illustrated. Upper mounting rail 48*a* is attached to the building 22 using fastener 80 in the usual fashion. Positioned behind spreader bar 78 is a backing sheet 100 which is secured to the building using angle brackets 102 and extension brackets 104 as required. The lower mounting rail 48*b* is secured to the backing sheet using nut and bolt fastener 96. Spreader bar 78 is likewise secured to the backing sheet with the same nut and bolt fastener 96.

Figure 7:
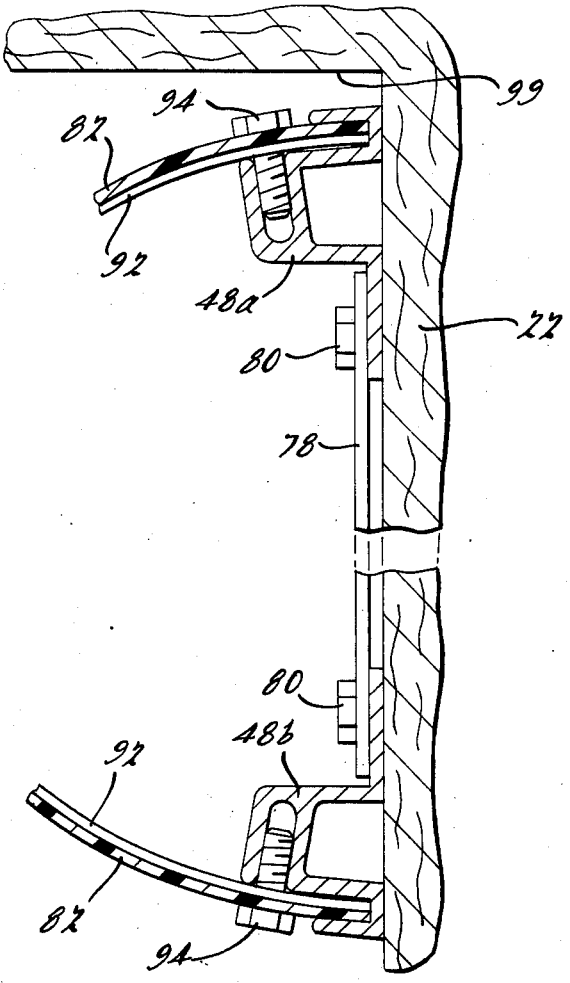
FIG. 7 is a cross-sectional view of the invention illustrating an installation in which the simulated pipe is installed beneath an eave or an outwardly extending or overhanging building structure.

In some applications, it may also be necessary to install the simulated pipe directly or entirely beneath a building overhang. FIG. 7 illustrates such an installation. In FIG. 7, the simulated pipe construction is essentially that of FIG. 3 previously described. In this installation, the pipeline is located immediately beneath building overhang 99. Although the end result is essentially the same as the pipeline construction of FIG. 3, the installation sequence is somewhat different due to the overhang. This installation sequence, as well as the normal installation sequence, will be discussed later.

Figure 8:
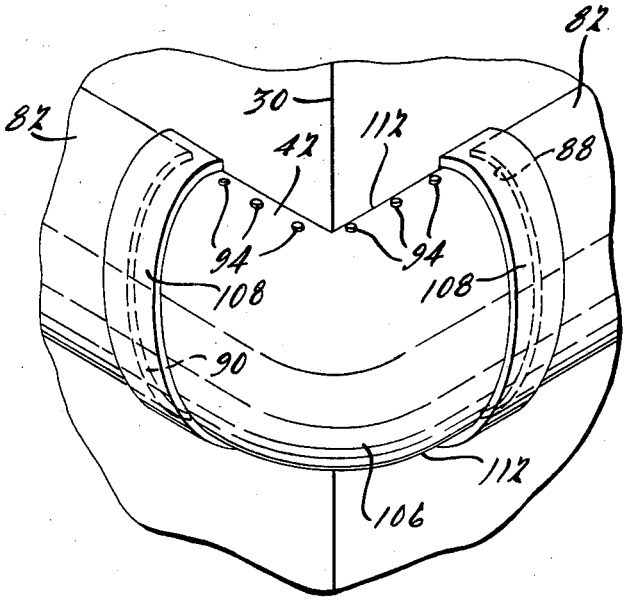
FIG. 8 illustrates the corner member of the invention and its installation.

In order to simulate a pipe extending around a corner of a building, the invention employs molded plastic corner members such as outside corner member 42 and inside corner member 44 (FIG. 1). FIG. 8 illustrates an outside corner in greater detail. The outside corner member 42 is preferably a one-piece molded plastic part having an elbow-shaped midsection 106 with collars 108 at both ends. Midsection 106 has a generally arc-shaped exterior which geometrically conforms to the arc-shaped configuration of the bowed panels. Collars 108 have a slightly larger radius which simulate the appearance of a plumbing pipe coupling or fitting. Collars 108 are adapted to overlap the transverse edges of the panels and be positioned outside the channels 72. The inside corner member 44 (FIG. 1) is also a one-piece molded plastic part of similar construction. End cap 46 is also a one-piece molded plastic part and is insertable into the channels of the upper and lower mounting rails in the same fashion. Corner members 42 and 44 and end cap member 46 are held in place by threaded panel mounting fasteners 94 which are secured in the fastener receiving channels 64 of the mounting rails.

Rather than use a molded corner piece 44 to carry the construction around an inside corner, it is also possible to simply utilize two of the panels 82. At the corner, one of the panels is extended flush against the opposing wall, while the second panel is cut along a curved line to fit tightly over the first panel.

Figure 9:
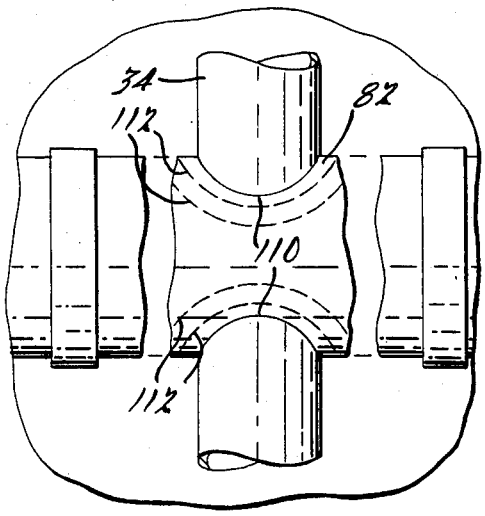
Figure 10A:
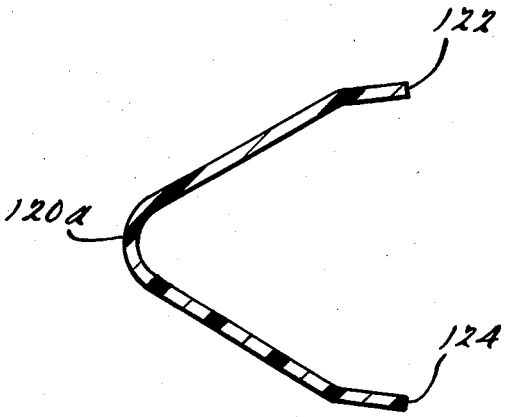
FIGS. 10*a*—10*e* illustrate alternate embodiments of panel shapes and design which can be utilized with the invention.
Figure 10B:
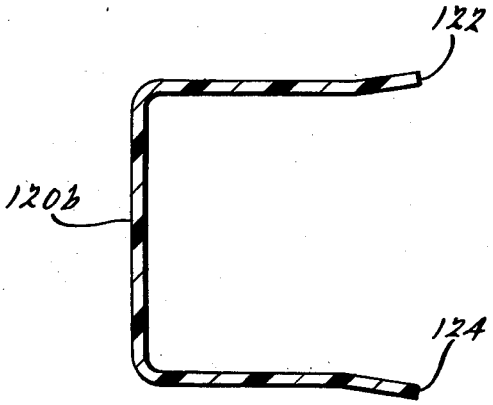
Figure 10C:
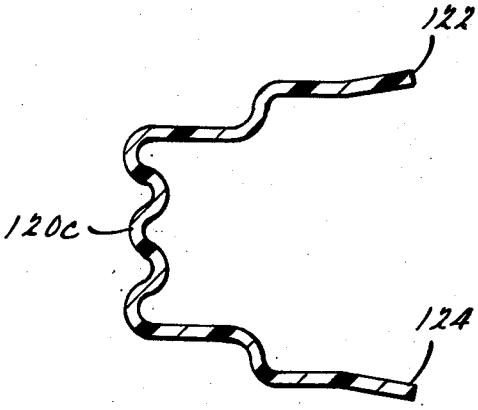
Figure 10D:
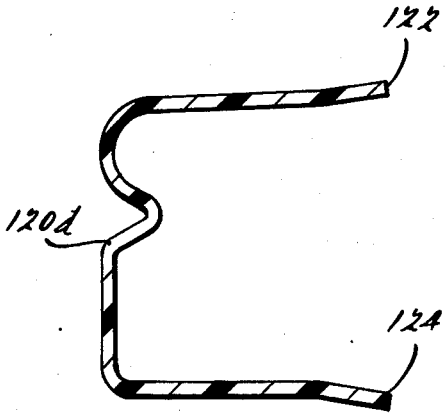
Figure 10E:
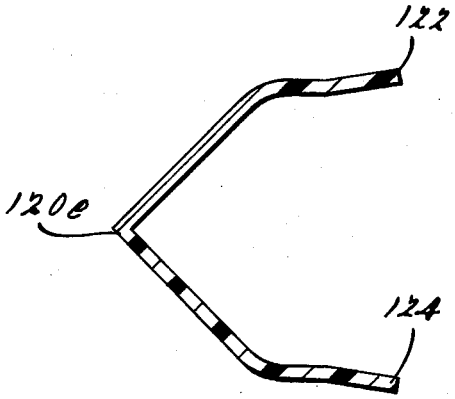

In order to accommodate downspouts, electrical conduits and other similar building fixtures, it may be necessary to provide a pair of side cuts or tapers in an elongated panel 82. This is illustrated in FIG. 9. In one alternative, tapers 110 are cut during installation to conform to the size and shape of the downspout 34. It is also possible to provide a separate preformed molded member for use in passing the simulated pipe construction over and around downspouts, electrical conduits and the like. The molded member could have a series of template lines 112 on the upper and lower edges outlining different sidecuts and indicating the sections to be cut out as needed on the job site.

The simulated pipeline is well adapted for storage, transportation and sale in kit form. The mounting rails and panels may be supplied in standard lengths, with six-foot lengths being presently preferred. The mounting rails may be readily cut to any desired length using a hacksaw or the like, and the panels may be readily cut using scissors, snips or a utility knife. Assembly of a simulated pipeline using the above-described components is easy to accomplish. Assuming the simulated pipe is to be attached to the vertical face of a building, and assuming that there are no obstructions or overhangs, the assembly preferably proceeds as follows.

Referring to FIG. 3, the upper mounting rail 48*a* is positioned on the face of building 22 with the attachment portion 50 contacting the building. A carpenter's level may be used to achieve the proper horizontal orientation of the mounting rail. Next, a fastener 80 is inserted through a hole in the upper end of spreader bar 78 and that fastener is then threadedly secured into the building structure. The precise fastener selected will depend upon the materials from which the building is constructed. Number 12 sheet metal screws, number 12 wood screws or ¼-inch lag bolts, are all suitable for this purpose. Depending on the length of the upper mounting rail, several additional spreader bars and fasteners are also employed at spaced positions along the length of the mounting rail. Preferably a minimum of two fasteners and two spreader bars are used for each six-foot section of mounting rail.

Next, the lower mounting rail **48*b* is secured to the building at the opposite end of the spreader bar or bars. Lower mounting rail 48*b* is secured using fasteners 80 in a similar fashion. The distance at which the mounting rails are separated depends upon the length of the spreader bar selected. The spreader bar, in turn, determines the apparent diameter of the simulated pipe. A presently preferred spreader bar may be on the order of 10⅜ inches, for example. After the upper and lower mounting rails have been secured to the building at the desired location, the flexible, elongated panels may then be installed. This is done by inserting one of the longitudinal edges of the panel into the channel of either the upper or the lower mounting rail. At this time, the metal backing members 92 are positioned behind the panel at its two transverse ends, and panel mounting fasteners 94 (or push darts 95) are used to secure the panel and backing member to the mounting rails. (One-half inch number 10 stainless steel sheet metal screws may be used as the panel mounting fasteners 94.) Each of the metal backing members 92** are preferably on the order of four inches wide and are positioned so that they will support the transverse edge of the panel being installed and also support the transverse edge of an adjacent panel yet to be installed. The backing members help hide the joints between adjacent panels and keep them together along the lengths of the joints.

The panel and backing member is then bowed by manually applied forces into an arc-shaped configuration. The remaining longitudinal edge is then inserted into the channel of the remaining mounting rail and additional fasteners 94 (or push darts 95) are used to secure the bowed panel in place. Next, an adjacent panel may be installed in the same fashion. Preferably, the adjacent panel is placed over the metal backing member already installed, and the transverse edge is aligned flush with the transverse edge of the previously installed panel. While this flush edge-to-edge installation is presently preferred, the panels might also be overlapped, by extruding the panel receiving channel 72 of sufficient size to accommodate the overlap.

In installations where, because of the building architecture, it is not possible to secure both upper and lower mounting rails to the building at each spreader bar location, modified installation procedures may be necessary. As explained above, FIGS. 5 and 6 illustrate alternate ways of mounting the lower mounting rail **48*b* in a suspended fashion. If the lower (or upper) mounting rail passes across a window or other material not suitable for mounting a screw, the lower (or upper) mounting rail is suspended from or supported by the upper rail by the spreader bars 78. In this instance, a nut and bolt fastener 96, such as a ¼-inch machine bolt and nut with lock washer 97, serve to secured the unsecured mounting rail to the spreader bar 78. It is recommended that this construction be used for lengths of less than five feet, as longer spans may require some form of backing member, such as that illustrated in FIG. 6. In the installation illustrated in FIG. 6, the backing sheet 100 is first cut to size and inserted between the spreader bar 78 and the building 22. Angle brackets 102 are installed as shown to secure the backing sheet in place. To avoid possible wind damage, extension brackets 104 may be used as illustrated. The lower mounting rail 48*b* is then attached to the backing sheet 100** using nut and bolt hardware, such as ¼-inch machine bolt, nut and lock washer.

As indicated earlier, it is necessary to alter the assembly procedure to install simulating pipe under an overhang, such as illustrated in FIG. 7. According to the altered procedure, the plastic panel 82 and metal backing member 92 are installed in the upper mounting rail **48*a*, and secured with mounting fasteners 94 before the upper rail is attached to the wall 22. This procedure eliminates the need for clearance above the simulated pipe for access to the upper fasteners 94. With the panel now secured to the upper mounting rail 48*a*, the rail is positioned on the building and attached with fasteners 80 as before. Installation then proceeds as described above; the lower mounting rail 48*b* is secured to the spreader bar 78 and building 22 with fastener 80, and the lower longitudinal edge of the panel 82 and backing member 92 are inserted into the channel of the lower rail with fasteners 94 or 95** holding them in place.

The corner members 42 and 44 and end cap members 46 are installed at the appropriate places by cutting or trimming the plastic panels approximately 4½ inches from the edge of a corner or approximately 3½ inches from the end of the simulated pipe. FIG. 8 illustrates panel edges 88 and 90 which have been trimmed to the appropriate distance from corner 30. Next, the corner member (or end cap) is placed over the trimmed edges so that the collars 108 extend over and overlap the trimmed edges. The longitudinal edges 112 of the mid-section 106 are then inserted into the channels of the upper and lower mounting rails. Mounting fasteners 94 or 95 are used to secure the corner member (or end cap) more permanently.

The simulated pipe construction will expand and contract with daily temperature changes. For a typical installation, sufficient clearance to accommodate such changes has been provided with the overlap of the end caps, elbows and drainpipe bypass sections as explained above.

Figure 11:
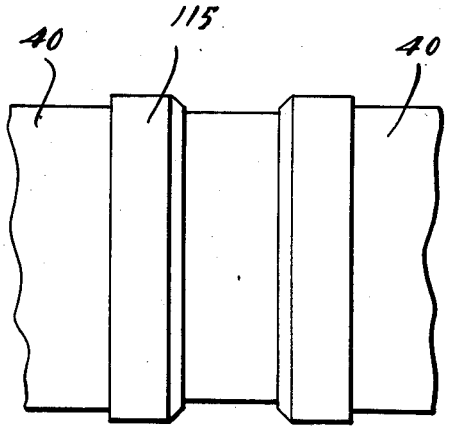
FIG. 11 depicts an expansion joint usable with one embodiment of the invention.

When a long uninterrupted segment of pipeline is utilized which is over forty feet long, and the pipeline will be exposed to direct sunlight, an expansion joint should be provided to accommodate the thermal expansion and contraction. An expansion joint should be added every 20 to 30 feet (4 to 6 panels). Preferably, five foot long panels should be assembled leaving a 7–8 inch gap on every 5th to 7th panel, and back-up plates should not be used at the gap. An expansion joint 115 (FIG. 11) is positioned over the gap with a one inch to a one and one-half inch overlap on each side. The expansion joint 115 is secured to the mounting rails by screws or other fasteners.

The resulting simulated pipe construction thus results in an advertising display structure which simulates the appearance of a plumbing pipe or pipeline without the weight and expense of installing an actual pipeline. The resulting simulated pipe is weatherproof, easy to repair and readily adapted for use on a wide variety of different building architectures in order to give the building a standardized appearance or to convey a theme.

As indicated above, the preferred form of the invention relates to a structure and system which bows out flat pieces of sheet material into an approximately semi-circular (or arc) shape simulating an actual pipe (or at least one-half thereof). It is also possible, however, in accordance with the broad scope of the invention to utilize other shapes and structures of material which are held in place by the same mounting rails (48*a* and 48*b*) and which simulate other structures, or display different designs. For example, as shown in FIGS. 10*a*–10*e*, several representative forms 120*a*–120*e* of other cross-sectional shapes are shown which could be utilized. All of the shapes have one or more elongated edges 122, 124 which have to be bent (or forced) to fit into the channels in the mounting rails to help hold and secure them in place.

With these shapes, several additional designs can be displayed on a building other than a pipe construction, such as an oval-type design 120*a*, a rectangular type design 120*b*, a wavy-type design 120*c*, a random-type design 120*d*, or a pointed-type design 120*e*. These shapes could be molded or extruded in the cross-sectional shapes shown and shipped to the building site (preferably nested together to save shipping space and costs).

While the invention has been described in connection with its presently preferred embodiment, the invention is capable of certain modification and change without departing from the spirit of the invention as set forth in the appended claims.

What is claimed is as follows:

1. A simulated pipe construction for attaching to a building having a plurality of corner defining faces comprising:

first and second pipe sections for attaching to two of said corner defining faces;

each pipe section having a first elongated and flexible panel having first and second edges in the longitudinal dimension and third and fourth edges in the transverse dimension;

each pipe section having at least one holding means having first and second edge securing means in spaced relation to one another for holding said first and second edges of said panels in said holding means;

said first and second edge securing means being closer together than the transverse dimension of said panel, so that said panel assumes an arc shaped configuration when held along said first and second edges by said holding means;

a spring force generated in said panel upon insertion such that said spring force is outwardly exerted against said holding means for holding said first and second longitudinal edges in said holding means;

corner means for attaching between two of said corner defining faces, said corner means having an arc-shaped exterior geometrically conforming to said arc-shaped configuration of said panel such that said corner means has a longitudinal radius for simulating bending of a pipe around two of said corner defining faces and having means for receiving and joining said third edge of said first pipe section panel and said fourth edge of said second pipe section panel so that said panel sections when so joined lie on lines which intersect one another thereby simulating a pipe extending around a corner of said building.

2. The simulated pipe construction of claim 1 wherein said edge securing means comprise spaced-apart parallel, channel forming rails.

3. The simulated pipe construction of claim 1 wherein said holding means comprises first and second channel forming rails and at least one spreader bar for securing between said rails to hold said rails in a spaced-apart and parallel configuration.

4. The simulated pipe construction of claim 1 wherein said first pipe section further includes a backing member behind at least a portion of said first elongated and flexible panel.

5. The simulated pipe construction of claim 1 wherein said corner means is elbow shaped.

6. The simulated pipe construction of claim 1 wherein said arc-shaped configuration describes less than a full circle.

7. The simulated pipe construction of claim 1 wherein said arc-shaped configuration describes a half circle.

8. The simulated pipe construction of claim 1 wherein said first pipe section has a second elongated and flexible panel carried by said holding means of said first pipe section and in end to end relationship with said first elongated and flexible panel of said first pipe section.

9. The simulated pipe construction of claim 8 wherein said first pipe section has a backing member behind at least the end to end portions of said first and second elongated and flexible panels.

10. An apparatus for assembly of a simulated pipe construction for attaching to a building comprising:

first and second elongated mounted rails each having an attachment portion for securing to a building and having a channel forming portion which defines an outwardly presenting elongated channel;

at least one spreader member having means for attaching said spreader member to said rails and for holding said rails in a spaced apart and parallel configuration with said channels a predetermined distance apart;

at least one elongated and flexible panel member having longitudinally extending edges for insertion into said channels of sad first and second rails;

said panel member having a width greater than said predetermined distance between said channels on said first and second rails such that said panel member takes on an outwardly bowed configuration when said longitudinally extending edges are inserted into said channels of said first and second rails; and a spring force generated in said panel upon insertion such that said spring force is outwardly exerted against said first and second rails for holding said first and second longitudinal edges in said first and second rails.

11. The apparatus of claim 10 wherein the width of said panel member is approximately one and one half times greater than said predetermined distance.

12. The apparatus of claim 10 wherein said rails are extruded.

13. The apparatus of claim 10 wherein said rails are extruded aluminum.

14. The apparatus of claim 10 wherein said attachment portion has a threaded fastener receiving means.

15. The apparatus of claim 10 further comprising backing member for positioning behind said panel member and inserting into said channels of said first and second rails.

16. The apparatus of claim 10 further comprising elbow member having one end for insertion into said channels and having an other end extending at right angle to said one end for simulating a pipe extending around a corner of a building.

17. The apparatus of claim 10 further comprising end cap member having one end for insertion into said channels and having another closed end for simulating an end capped pipe section.

18. The apparatus of claim 10 wherein said rails have fastener receiving means adjacent said channels for use in securing said panel member within said channels.

19. The apparatus of claim 10 wherein said panel member is of a plastic material.

20. A mounting rail for the assembly of a simulated pipe comprising:

an elongated extrusion having an attachment portion which lies substantially in a first plane and which has an inwardly facing attachment side and an outwardly facing side;

an extension portion exending laterally outwardly from said attachment portion and lying substantially in a second plane;

first and second fastener receiving flanges extending from said extension portion and lying generally parallel to one another to define a fastener receiving channel;

said fastener receiving channel lying substantially in a third plane which intersects said second plane;

a panel holding portion extending laterally inwardly from said second fastener receiving flange;

said holding portion having first and second panel holding extensions lying generally parallel to one another to define a panel receiving channel; and said panel receiving channel lying substantially in a fourth plane which intersects said first and third planes.

21. The mounting rail of claim 20 wherein said attachment portion has a longitudinally exending pilot groove in the outwardly facing side.

22. The mounting rail of claim 20 wherein said first and second planes intersect at right angles.

23. The mounting rail of claim 20 wherein said first and third planes intersect.

24. The mounting rail of claim 20 wherein said holding portion includes a base portion disposed between said panel holding extensions.

25. The mounting rail of claim 24 wherein said base portion lies substantially in said first plane.

26. The mounting rail of claim 20 wherein said first and third planes intersect in an acute angle.

27. The mounting rail of claim 27 wherein said acute angle is approximately 10–15 degrees.

28. The mounting rail of claim 20 wherein said first and fourth planes intersect at an acute angle.

29. The mounting rail of claim 28 wherein said acute angle is approximately 80–85 degrees.

30. A method of simulating a pipeline attached to a building comprising:

securing a first mounting rail to said building, said first mounting rail having an elongated outwardly presenting channel;

locating a second mounting rail in spaced parallel relation to said first mounting rail at a fixed predetermined distance from said first mounting rail and securing said second mounting rail to said building, said second mounting rail having an elongated outwardly presenting channel;

inserting one longitudinal edge of at least one elongated flexible panel in the channel of said first mounting rail, said panel having a transverse dimension greater than said predetermined distance;

outwardly bowing said panel and inserting a second longitudinal edge of said panel in the channel of said second mounting generating an outward spring force in said panel upon insertion of said second longitudinal edge such that said spring force holds said panel in said rail channels; and securing said longitudinal edges in said channels, positioning a second elongated flexible panel beside said one elongated flexible panel and inserting the longitudinal edges thereof in the channels of said rails.

31. The method of claim 30 further comprising locating said second mounting rail by fastening at least one spreader means between said first and second rails.

32. The method of claim 30 wherein said rails each have fastener receiving means adjacent said channels and said longitudinal edge securing step is performed by passing fastener means through said panel and into said receiving means.

33. The method of claim 30 further comprising positioning a backing member behind said panel and inserting said backing member into said channels.

34. The method of claim 30 further comprising inserting an end cap member into said channels.

35. The method of claim 30 further comprising securing said first mounting rail to said building before inserting said longitudinal edge into the channel thereof.

36. The method of claim 30 further comprising securing said first mounting rail to said building after inserting said longitudinal edge into the channel thereof.

37. The method of claim 30 further comprising attaching a second outwardly bowed panel to said building so that said one panel and said second panel lie on intersecting lines; and joining said one panel and said second panel by inserting a corner member in said channels of said first and second mounting rails and at least partially overlapping said panels with said corner member.

38. A construction for attachment to a building having a plurality of corner defining faces comprising:

first and second sections for attaching to two of said corner defining faces;

each section having a first elongated panel having first and second edges in the longitudinal dimension and third and fourth edges in the transverse dimension, at least one of the first or second elongated edges being flexible;

each section having at least one holding means having first and second edge securing means in spaced relation to one another for holding said first and second edges of said panels in said holding means;

said first and second edge securing means being closer together than the transverse dimension of said panel;

a spring force generated in said panel upon insertion such that said spring force is outwardly exerted against said holding means for frictionaly holding said first and second longitudinal edges in said holding means;

corner means for attaching between two of said corner defining faces, said corner means having an exterior geometrically conforming to said configuration of said panel and having means for receiving and joining said third edge of said first panel and said fourth edge of said second panel so that said panel sections when so joined lie on lines which intersect one another thereby extending the construction around a corner of said building.

39. The construction of claim 38 wherein said edge securing means comprise spaced-apart parallel, channel forming rails.

40. The construction of claim 38 wherein said holding means comprises first and second channel forming rails and at least one spreader bar for securing between said rails to hold said rails in a spaced-apart and parallel configuration.

41. The construction of claim 38 wherein said first section has a second elongated and flexible panel carried by said holding means of said first section and in end-to-end relationship with said first elongated and flexible panel of said first section.

42. The construction of claim 38 wherein said corner means is elbow shaped.

43. The construction of claim 38 wherein said first section further includes a backing member behind at least a portion of said first elongated and flexible panel.

44. The construction of claim 43 wherein said first section has a backing member behind at least the end-to-end portions of said first and second elongated and flexible panels.

* * * * *

UNITED STATES PATENT AND TRADEMARK OFFICE

CERTIFICATE OF CORRECTION

PATENT NO. : 4,696,136

DATED : September 29, 1987

INVENTOR(S) : Ronald E. Grewe

It is certified that error appears in the above-identified patent and that said Letters Patent is hereby corrected as shown below:

Column 7, line 66, "secured" should be --secure--.

Column 10, line 33, "mounted" should be --mounting--.

Column 10, line 44, "sad" should be --said--.

Column 11, line 23, "exending" should be --extending--.

Column 11, line 54, "Claim 27" should be -- Claim 26--.

Column 12, line 9, insert --rail;-- after "mounting".

Signed and Sealed this

Nineteenth Day of July, 1988

*Attest:*

DONALD J. QUIGG

*Attesting Officer*

*Commissioner of Patents and Trademarks*